US006221214B1

(12) United States Patent
Kotitschke et al.

(10) Patent No.: US 6,221,214 B1
(45) **Date of Patent: *Apr. 24, 2001**

(54) WET PRESS AND METHOD FOR TREATING A FIBROUS MATERIAL WEB

(75) Inventors: Gerhard Kotitschke, Steinheim; Wolfgang Mayer, Heidenheim; Klaus Esslinger, Nattheim; Andreas Meschenmoser, Horgenzell, all of (DE); Günther Morhardt, San Paolo (BR)

(73) Assignee: Voith Sulzer Papiermaschinen GmbH, Heidenheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/996,221

(22) Filed: Dec. 22, 1997

(30) Foreign Application Priority Data

Dec. 23, 1996 (DE) ..... 196 54 200

(51) Int. Cl.[7] ..... D21F 3/04

(52) U.S. Cl. ..... 162/210; 162/305; 162/358.3; 162/358.2

(58) Field of Search ..... 162/210, 358.3, 162/305, 358.2

(56) References Cited

U.S. PATENT DOCUMENTS

| | | | | |
|---|---|---|---|---|
| 4,492,611 | * | 1/1985 | Meinander | 162/360.2 |
| 4,879,001 | * | 11/1989 | Cronin | 162/360.2 |
| 5,389,205 | * | 2/1995 | Pajula et al. | 162/210 |
| 5,393,384 | * | 2/1995 | Steiner et al. | 162/360.2 |
| 5,522,959 | * | 6/1996 | Imarinen | 162/210 |
| 5,620,566 | * | 4/1997 | Holopainen | 162/210 |
| 5,695,612 | | 12/1997 | Holopainen . | |
| 5,709,778 | * | 1/1998 | Kade et al. | 162/358.3 |

(List continued on next page.)

FOREIGN PATENT DOCUMENTS

| | | | |
|---|---|---|---|
| 44784 | | 1/1990 | (AT) . |
| 4224730 | | 9/1993 | (DE) . |
| 0043289 | | 1/1982 | (EP) . |
| 0100895 | | 2/1984 | (EP) . |
| 0359696 | | 3/1990 | (EP) . |
| 0657579 | | 6/1995 | (EP) . |
| 2071293 | * | 9/1981 | (GB) ..... 162/358.2 |
| 95/33885 | | 12/1995 | (WO) . |

*Primary Examiner*—Karen M. Hastings
(74) *Attorney, Agent, or Firm*—Greenblum & Bernstein, P.L.C.

(57) ABSTRACT

A wet section of a machine for producing a fibrous material web that includes at least one press. The press includes a nip through which the fibrous material web is guided. The fibrous material web is preformed in a web forming zone. At least one press is an elongated nip press that is elongated in direction of the web travel. This nip is positioned in a region where the dry matter content of the preformed fibrous material web that comes into the nip is less than or equal to about 15% and, preferably is less than or equal to about 12%. A method for treating a fibrous material web in a wet section of a machine for producing the fibrous material web. The wet section includes at least one press including an elongated nip, at least one press and the elongated nip are elongated in a web travel direction. Further, the elongated nip is positioned in a region of the machine where the dry matter content of the fibrous material web, as it enters the elongated nip, is less than or equal to about 15%. The method includes preforming the fibrous material web in a forming section of the machine, guiding the fibrous material web to the at least one elongated nip, and pressing the fibrous material web in the at least one elongated nip elongated nip.

23 Claims, 4 Drawing Sheets

U.S. PATENT DOCUMENTS 5,753,084 * 5/1998 Bubik et al. ..... 167/358.3
5,792,320 * 8/1998 Kaasalainen et al. ..... 162/210
5,820,731 * 10/1998 Soderholm ..... 162/210
5,833,810 11/1998 Laapotti .
5,865,954 2/1999 Laapotti .
5,868,904 2/1999 Laapotti .

* cited by examiner

WET PRESS AND METHOD FOR TREATING A FIBROUS MATERIAL WEB

CROSS-REFERENCE TO RELATED APPLICATION

The present application claims priority under 35 U.S.C. § 119 of German Patent Application No. 196 54 200.6 filed Dec. 23, 1996, the disclosure of which is expressly incorporated by reference herein in its entirety.

BACKGROUND OF THE INVENTION

1. Field of the Invention

The present invention relates to a wet section of a machine for producing a fibrous material web, specifically a paper or a cardboard web, which includes at least one press unit that includes a nip through which the fibrous material web, which has been preformed in a web forming section, is guided.

The present invention also relates to a method for treating a fibrous material web in an elongated nip of a press section of a machine for producing a fibrous material web. The method includes preforming the fibrous material web in a forming section of the machine, guiding the fibrous material web, which has a dry matter content of approximately 15%, to at least one elongated nip and pressing the fibrous material web in at least one elongated nip.

2. Discussion of Background Information

The wet section of machines for producing a fibrous material web, particularly for producing either a paper or a cardboard web, occur after the web forming region and after the fibers have achieved a certain immobility gradient. Further drainage of the wet fibrous material web has, in the past, primarily been achieved by elements that essentially operate through the use of suction, such as, for example, particular foils, register rolls, suction boxes, suction rolls, or the like. Connecting this type of drainage to the machine incurs considerable expense, especially where, for example, the element requires a large amount of space or, for example, where generating the vacuum consumes an excessively large amount of costly energy. In addition, depending on the type of material, the drainage screen, which rubs over the mostly stationary drainage elements, may result in a relatively short screen service life.

In a wet section of the type discussed in EP-A-0 359 696, a press function is integrated into the screen region to eliminate a web pick-up point. The press point provided in the screen region includes a suction roll and an open roll. Either the relevant nip is not very hard, i.e. having a high linear force, or the nip is very short and soft, which can be attributed to a low linear force. Neither of these operations is suitable for removing the required quantity of water from the fibrous material web with the lowest possible pressure gradients when there are low dry matter contents, i.e. when the fibrous material web is still wet.

SUMMARY OF THE INVENTION

The present invention provides the ability to drain the pre-formed wet fibrous material web of a wet section of a machine while utilizing a minimal expenditure of energy, a small amount of space, and a correspondingly low operating cost.

The invention provides at least one long-nip press or elongated nip press, which is elongated in the web travel direction. The nip is positioned in a region or area where the dry matter content of the preformed fibrous material web coming into the nip is less than or equal to about 15%, and preferably, is less than or equal to about 12%.

The present invention may be used, for example, on gap formers, hybrid formers, fourdrinier wires, multistage fourdrinier wires, and/or the like. The nip length can be adapted to the respective types of production. Because the relevant press point is disposed closer to the headbox, the fibrous material web is warmer during pressing, which further increases the drainage capacity. In addition, lower screen wear is produced and the energy costs are clearly reduced. The pressing occurs in an extremely gentle fashion, wherein the progression of pressing power can be predetermined by a corresponding shoe embodiment (e.g. the length or shape or form of the shoe).

In fact, the pressure applied to the fibrous material web may increase in the traveling direction of the fibrous material web from approximately 1 bar to approximately 20 bars. Preferably, the pressure increases from about 1 bar to between about 5 and 10 bars.

At least one screen associated with the web forming zone is guided through the elongated nip. In particular industrial applications, it is advantageous to guide two screens associated with the web forming zone through the nip.

The fibrous material web, which is preformed in the web forming zone, can also be delivered to the nip by a water-absorbing belt. The fibrous material web is transferred onto the water-absorbing belt before the elongated nip. The water-absorbing belt can be, for example, a felt band, a screen belt, and/or a perforated belt.

Another embodiment of the invention provides for at least one belt being positioned on both sides of the fibrous material web and then being guided through the nip. The belts on either side of the fibrous material web are designed to be the same, i.e, symmetrical.

In this instance, starting from the fibrous material web, a support belt that supports the fibrous material web and is preferably comprised of fine woven cloth, a belt of porous woven cloth that serves to absorb and transport water, and a waterproof belt, are provided on each side of the web. In this instance, the support belt is preferably a felt band and/or screen belt.

It is also possible to provide a thick felt band and a waterproof belt, respectively, on each side of the web, starting from the fibrous material web.

However, it is also conceivable to provide a belt comprised of a fine woven cloth, a porous, coarse belt, and a waterproof belt, respectively, on each side of the web, starting from the fibrous material web. The belt comprised of fine woven cloth can, for example, be a screen belt.

In another suitable embodiment of the wet section according to the invention, at least one belt is on both sides of the fibrous material web and is respectively guided through the nip. The belts on either side of the fibrous material web are not the same, that is, they are asymmetrical.

For example, one asymmetrical belt design includes a felt band and a waterproof belt on one side of the web and a screen belt, a porous, coarse belt, and a waterproof belt provided on the other side of the web.

With an asymmetrical design like this, it is also possible, starting from the fibrous material web, to provide a waterproof belt on one side of the web and a screen belt, a porous, coarse belt, and a waterproof belt on the other side of the web.

In the embodiment, it is preferable to have an elongated nip formed between a rotating, flexible press belt, which is guided by at least one press shoe, and an opposing press face. Consequently the elongated nip can be formed, in particular, by a press shoe.

Because the pressing power exerted at low dry matter contents is relatively low, the region between the press shoe and the flexible press belt may be lubricated in a suitable fashion with water. As a result, there is also the possibility, in particular, of using the relevant press shoe in a continuous loop that is open on its end faces and to use an open system in which the shoe length can be relatively large.

According to one embodiment of the invention, the continuous loop formed by the rotating, flexible press belt may be open on its two end faces.

To form the first elongated nip that the web fibrous material web approaches, preferably, a press shoe is provided that includes a press face. The press face is at least substantially smooth on the jacket or flexible press belt side. In this instance, the woven cloths that travel through the nip may undergo less mechanical bending stress. Thus, the cloths or fabrics may be thicker and, thus, absorb more water.

Preferably, the wet section includes a headbox that is also supplied with dilution water.

According to one embodiment, the wet section is adapted to be used in combination with at least one other long-nip press or elongated nip press and a transfer zone where the fibrous material web is transferred to a dryer section. Preferably, the fibrous material web is guided so that, for the most part, a closed or continuous web guidance is produced.

According to one aspect of the invention, the first nip may be followed by at least one other nip, which can be a nip or an elongated nip.

To form a nip that is elongated in the web travel direction, a press belt may be provided that is guided by at least one press shoe. The press belt is further guided in an at least a substantially circular cylindrical fashion outside the shoe region and, thus, assumes the shape of a roll.

On the whole, the wet section according to the present invention produces lower screen wear. The energy costs are further minimized. Because the first press point is disposed closer to the headbox, the material cools less, which facilitates the drainage. The pressing is performed in an extremely gentle fashion, wherein the progression of pressing power can be predetermined by a corresponding shoe embodiment, such as, for example the length and shape of the shoe. In addition, the pressing is as volumetrically gentle as possible.

Another way to state the invention is a wet section of a machine for producing a fibrous material web including a web forming section that preforms the fibrous material web and at least one press that includes an elongated nip through which the fibrous material web is guided. At least one press and the elongated nip are elongated in a web travel direction. Further, the elongated nip is positioned in a region of the machine where the dry matter content of the fibrous material web, as it enters the elongated nip, is less than or equal to about 15%.

According to one aspect of the invention, the fibrous material web may be either a paper web or a cardboard web.

According to another aspect of the invention, the dry matter content of the fibrous material web may be less than or equal to about 12% as it enters the elongated nip.

Further, the fibrous material web may be transferred from the web forming section to a belt that delivers the fibrous material web to the elongated nip.

The wet section may include at least one screen belt that is associated with the web forming section. At least one screen belt may be guided through the elongated nip.

Further, the invention may include two screen belts, which are associated with the web forming section and are guided through the elongated nip.

According to one aspect of the invention, a water-absorbing belt may take the fibrous material web from the web forming section to the elongated nip. Further, the belt may be composed of either a felt band, a screen belt or a perforated belt.

According to yet another aspect of the invention, there may be at least two belts which sandwiching the fibrous material web. The two belts may be composed of the same material and at least one of the two belts may be guided through the elongated nip.

According to yet another aspect of the invention, the belts may include at least one support belt and at least one waterproof belt. Further, the invention may include at least two support belts, each supporting the fibrous material web on both sides of the fibrous material web. Further, the invention may include two waterproof belts, each waterproof belt associating with a corresponding support belt.

It is possible that at least one support belt may be composed of a porous, fine woven cloth or a felt belt, or a screen belt.

According to one aspect of the invention, at least one support belt may be composed of at least one thick felt band and the waterproof belt may be composed of at least one waterproof belt. At least one felt band may associate with a corresponding waterproof belt and this combination may be provide don on both sides of the fibrous pulp sheet.

It is possible for the belt combination to include at least one fine woven cloth belt, at least one porous course belt and at least one waterproof belt. Both sides of the fibrous material web, moreover, may be provided with this combination of belts.

It is possible, moreover, for the fine woven cloth belt to be composed of a screen belt.

Further, according to yet another aspect of the invention, the fibrous material web may include a first side and second side that is positioned opposite the first side. The first side may be associated with at least one belt and the second side may be associated with at least one belt. The belt or belts that are associated with the first side of the fibrous material web may be a different combination of belts that is associated with the second side of the fibrous material web. Further, at least one belt associated with the first side and at least one belt associated with the second side may be guided through the elongated nip.

It is possible, moreover, for at least one belt associated with the first side of the fibrous material web to be composed of a felt band and/or a waterproof belt and at least one belt associated with the second side of the fibrous material web to be composed of a screen belt, a porous, coarse belt and a waterproof belt.

It is possible, moreover for the first side of the fibrous material web to be provided with a waterproof belt and the second side of the fibrous material web to be provided with a screen belt, a porous course belt and a waterproof belt.

The wet section may further include a rotating flexible press belt and at least one press shoe that guides the rotating flexible press belt. Further, the elongated nip may be formed between the rotating flexible press belt and an opposing face.

The region between at least one press shoe and the rotating flexible press belt may be lubricated with water.

It is possible, moreover, for the rotating flexible press belt to form a continuous loop that includes two end faces. The continuous loop, moreover, may be open on the two end faces.

The wet section may further include a shoe press that is positioned adjacent the elongated nip. The press shoe may include a press face, and the press face may be substantially smooth on the side of the flexible press belt or jacket side.

The wet section may also be associated with a headbox that supplies the fibrous material pulp and dilution water.

It if further possible that the wet section may be adapted for use in combination with at least one additional elongated nip and a transfer zone, where the fibrous material web is transferred to a dryer section of the machine. The fibrous material web is, preferably, guided so that a substantially continuous web guidance is produced.

Another way to state the invention is a wet section of a machine for producing a fibrous material web that includes a web forming section to form the fibrous material web and at least one press section that includes at least one elongated nip through which the fibrous material web is guided. At least one press and at least one elongated nip are elongated in a web travel direction.

According to another aspect of the invention, the fibrous material web may be either a paper web or a cardboard web.

Further, the dry matter content of the fibrous material web may be less than or equal to about 15% as it enters a first at least one elongated nip or it may be less than or equal to about 12% as it enters a first at least one elongated nip.

According to another aspect of the invention, the wet section may be positioned between the web forming section and a dryer section.

Further, the wet section may be associated with at least one belt to transport the fibrous material web. It is possible for the belt to be screen belt or a felt belt. Moreover, it is possible to have two sets of belts sandwiching the fibrous material web.

The sets of belts may be composed of water absorbent material or water impermeable materials.

Further, the two sets of belts may be composed of either a different profile of belts or a substantially identical profile of belts.

The present invention also includes a method for treating a fibrous material web in a wet section of a machine for producing the fibrous material web. The wet section includes at least one press, which includes an elongated nip. At least one press and the elongated nip are, moreover, elongated in a web travel direction and the elongated nip is positioned in a region of the machine where the dry matter content of the fibrous material web as it enters the elongated nip is less than or equal to about 15%. The method includes preforming the fibrous material web in a forming section of the machine, guiding the fibrous material web to the at least one elongated nip and pressing the fibrous material web in at least one elongated nip elongated nip.

Further, the dry matter content of the fibrous material web may be less than or equal to about 12% as it enters the elongated nip.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein.

DETAILED DESCRIPTION OF THE PRESENT INVENTION

Figure 1:
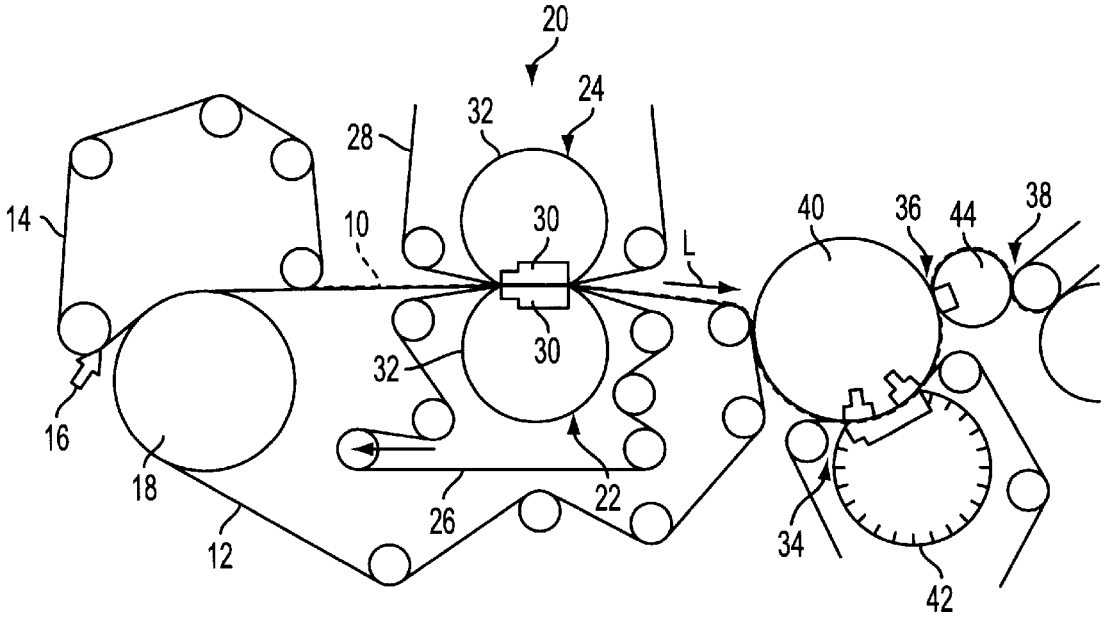
FIG. 1 is a schematic side view of an embodiment of a wet section with a nip that is elongated in the web travel direction and is positioned between two press shoe rolls.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

FIG. 1 shows, in a schematic side view, shows an embodiment of a wet section of a machine for producing a fibrous material web, in particular a paper and/or cardboard web.

In this wet section, a web forming zone, which includes two convergent screens or sieves or belts 12, 14 is furnished with at least one fibrous suspension flow by a headbox 16. The headbox 16 is only briefly indicated by an arrow. In this connection, the lower screen 12 is guided around a forming roll 18.

Figure 6:
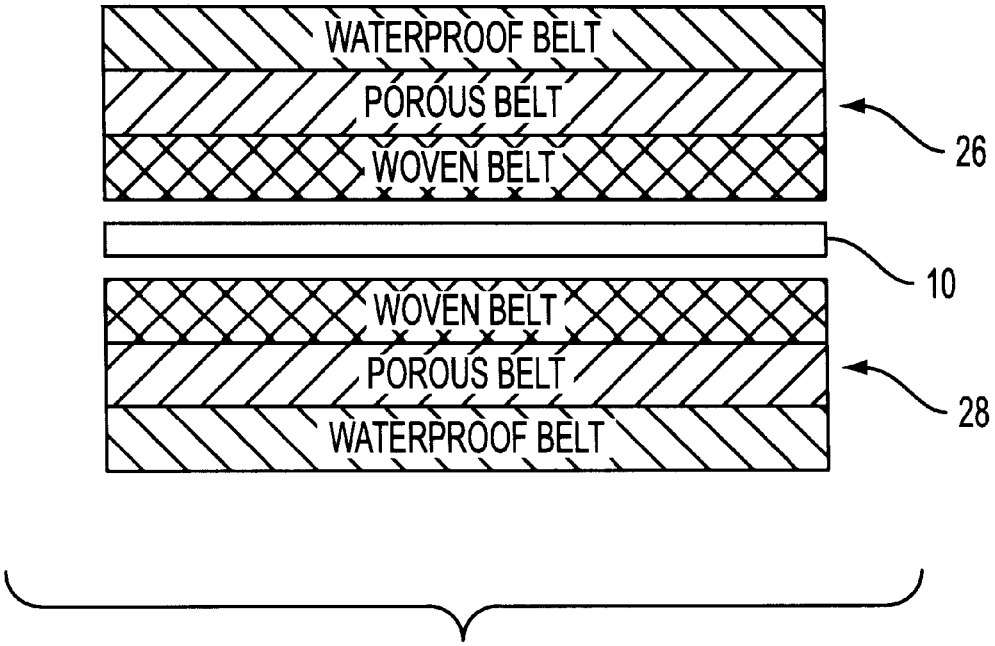
FIG. 6 represents an example of a belt arrangement employed with the present invention.

The wet section includes a long-nip or elongated nip press 20 with a nip that is elongated in the web travel direction L and is formed between two shoe press rolls 22, 24. A belt 26 is guided around the lower shoe press roll 22 and a second belt 28 is guided around the upper shoe press roll 24. The belts 26, 28 can be, for example, a screen belt or a felt belt or band. An example of such a belt arrangement is shown in FIG. 6. While FIG. 6 illustrates that the composition of each belt 26 and 28 are symmetrical, as noted above, the composition of the belts 26 and 28 may differ from one another.

The nip formed by the elongated nip or the long-nip press 20 is disposed in a region where the dry matter content of the preformed fibrous material web 10 coming into the nip is less than or equal to about 15% and, preferably, is less than or equal to about 12%.

As can be seen in FIG. 1, only the lower screen 12, of the two screens 12, 14 that are associated with the web forming zone, is guided through the nip of the long-nip press 20.

The two shoe press rolls 22 and 24 each include a flexible press belt or jacket 32 guided by a shoe press 30. The region between the shoe presses 30 and the flexible press belt 32 is lubricated with water. In addition, the shoe presses 30 in the current instance each have a press face that is at least substantially smooth on the jacket side or the flexible press belt side.

The wet section is provided in combination with two other presses 34, 36, of which the one, namely the press 34, is a long-nip or an elongated nip press, and a transfer zone 38 for a transfer of the fibrous material web 10 into the dryer section (not shown). The fibrous material web 10 is guided so that, for the most part, a continuous web guidance is achieved.

In the current instance, the two other presses 34, 36 include a central deflection compensation roll 40 that has a smooth roll jacket surface, i.e. the roll jacket is closed. The two other presses further include another shoe press roll 42 and another press roll 44. The central, smooth deflection compensation roll 40 takes over the fibrous material web 10 directly from the lower screen 12.

Figure 2:
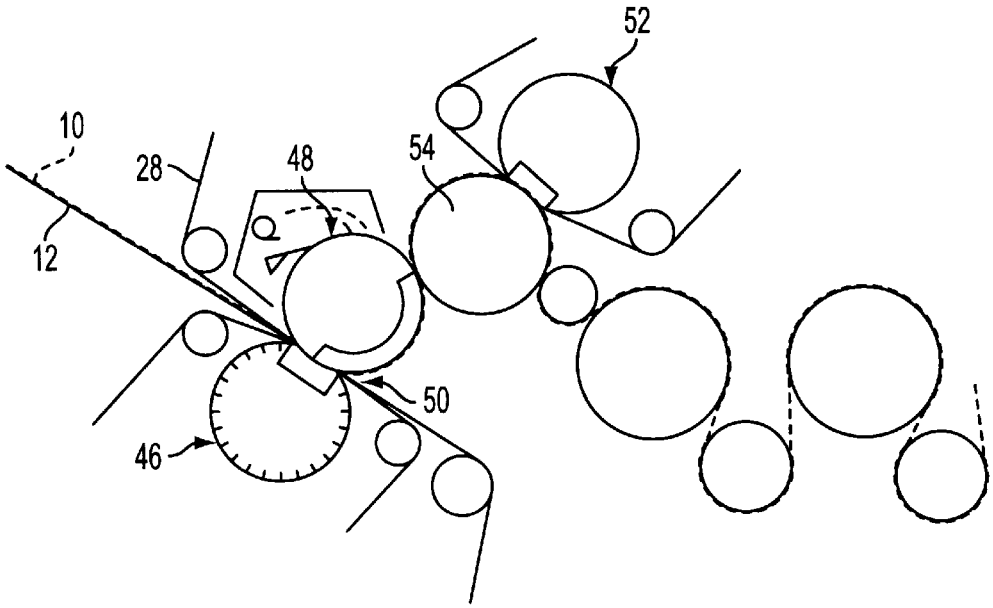
FIG. 2 is a schematic side view of another embodiment of a wet section with a nip that is elongated in the web travel direction and is embodied between a press shoe roll and a suction roll.

FIG. 2 is a schematic side view diagram of another embodiment of a wet section. This wet section also includes a nip that is elongated in the web travel direction. In this instance, the elongated nip is formed between a shoe press roll 46 and a suction roll 48. The correspondingly obtained long-nip press 50 is in turn provided in a region in which the dry matter content of the preformed fibrous material web coming into the nip is less than or equal to 15% and is preferably less than or equal to 12%. As can be further inferred from FIG. 2, only the lower screen 12 of the two screens 12, 14 associated with the web forming zone is guided through the nip of the long-nip press 50 (compare to FIG. 1). The web forming zone in the region of the forming roll is constructed in the same manner as in the embodiment of FIG. 1.

From the belt 28 guided via the central suction roll 48, the fibrous material web 10 is taken over by another central roll 54 disposed between the suction roll 48 and another press roll 52 so that after the elongated nip of the long-nip press 50, two additional nips are produced before the fibrous material web 10 is supplied to the drier section.

Figure 3:
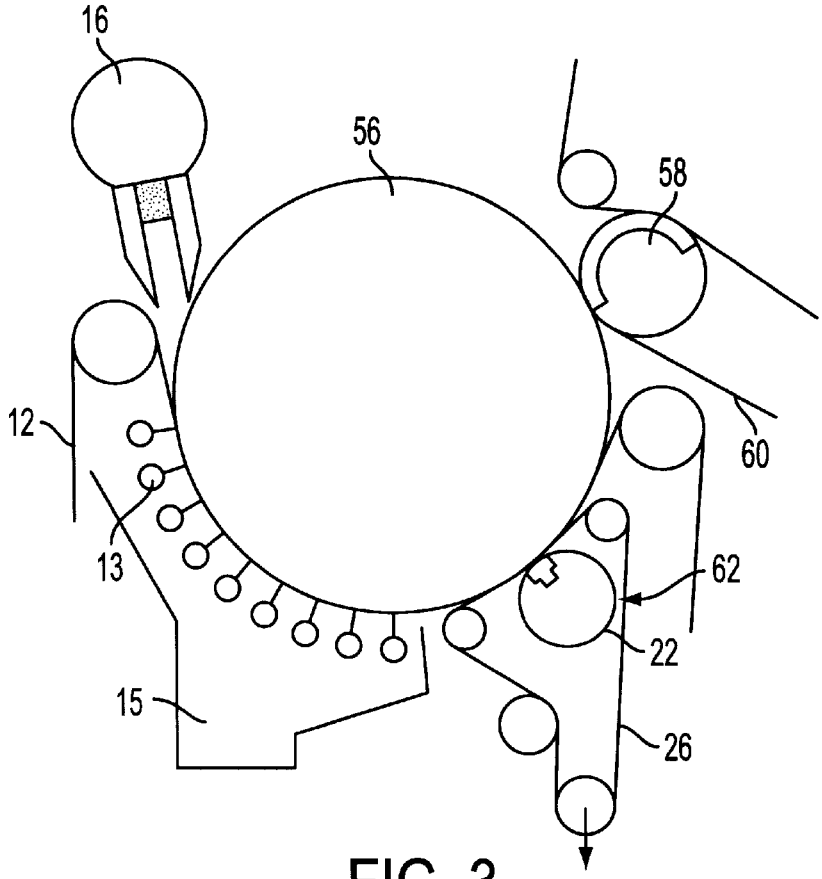
FIG. 3 is a schematic side view of another embodiment of a wet section with a nip that is elongated in the web travel direction and is embodied between a forming roll and a press shoe roll.

In a schematic side view, FIG. 3 shows another embodiment of a wet section with a nip that is elongated in the web travel direction. In this instance, the elongated nip is formed between a forming roll 56 and a shoe press roll 22 around which, in turn, a belt 26 is guided. A lower screen 12 associated with the web forming zone is guided around the forming roll 56. The headbox 16 supplies the incoming side of the nip. The nip is formed between the lower screen 12 and the forming roll 56, including at least one fibrous suspension flow so that the fibrous material web is produced between the lower screen 12 and the forming roll 56.

In FIG. 3, the forming roll includes pneumatically loaded blades 13 that remove the water which permeates the lower screen 12. Further, the pneumatically loaded blades 13 create, between the lower screen 12 and the forming roll 56, pressure pulsations in the suspension which improves the quality of the finished paper. The water collection receptacle 15 collects the drainage from the forming web.

From the forming roll 56, the fibrous material web is eventually taken over by a felt belt 60 guided around a suction roll 58. The fibrous material web may then be taken to other nips, which can, in turn, be formed by at least one long-nip press.

In the embodiment shown in FIG. 3, the first long-nip press 62 that includes a shoe press 22 is provided in the region of the forming roll 56, wherein the relevant elongated nip is formed between this forming roll 56 and the shoe press roll 22. Also in this instance, the long-nip press is again disposed in a region where the dry matter content of the preformed fibrous material web coming into the relevant nip is less than or equal to about 15% and, preferably, is less than or equal to about 12%.

Figure 4:
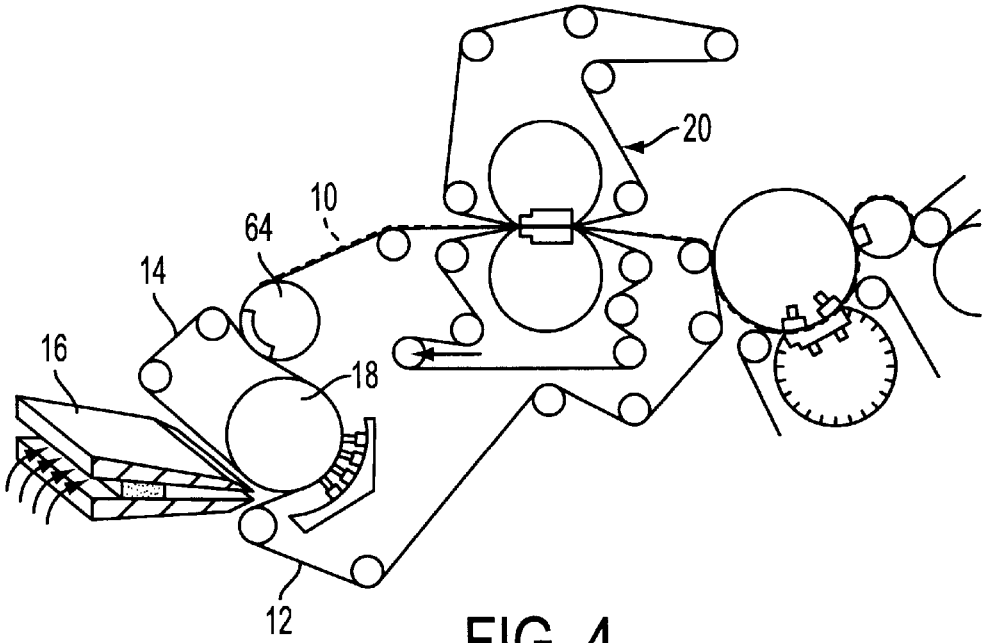
FIG. 4 is a schematic side view of another embodiment of a wet section with a headbox that is additionally supplied with dilution water.

FIG. 4 is a schematic side view of another embodiment of a wet press that includes a headbox 16 that is also supplied with dilution water.

In one instance, the forming roll 18 is disposed in the loop of the upper screen 14, while the lower screen 12 is guided by this forming roll 18 around which the screen 14 winds. After the forming roll 18, the screen 12 is guided around a suction roll 64 to then supply the preformed fibrous material web 10 to the first elongated nip formed by the long-nip press 20.

Otherwise, this embodiment according to FIG. 4 has essentially the same structure as the wet section shown in FIG. 1. Therefore, in this case as well, only the lower screen 12 of the two screens 12, 14 that are associated with the web forming zone is guided through the first elongated nip. Here, too, the relevant nip that is elongated in the web travel direction is again positioned in a region where the dry matter content of the preformed fibrous material web coming into the nip is less than or equal to about 15% and, preferably, is less than or equal to about 12%.

Figure 5:
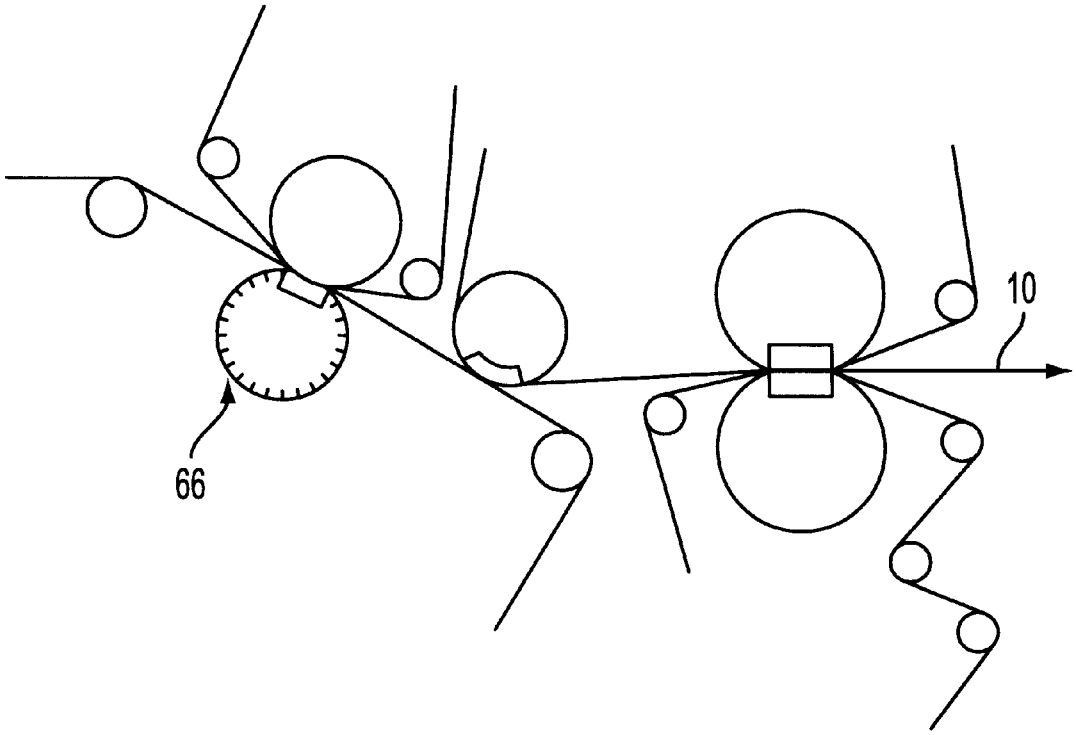
FIG. 5 shows another embodiment, with a separate press shoe before the pick-up in the press section.

FIG. 5 shows another embodiment of the present invention that includes a separate shoe press 66 before being guided to a suction box and at least one long nip shoe press in the press section of machine.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and the spirit of the invention in its aspects. Although the invention has been described herein with reference to particular means, methods, materials and embodiments, the invention is not intended to be limited to the particulars disclosed herein; rather, the invention extends to all functionally equivalent structures, methods and uses, such as are within the scope of the appended claims.

Reference Numeral List

10 fibrous material web
12 screen
13 pneumatically loaded blades
15 water collection receptacle
14 screen
16 headbox
18 forming roll
20 elongated nip press
22 shoe press roll
24 shoe press roll
26 belt
28 belt
30 shoe press
32 flexible press belt
34 elongated nip press
36 press
38 transfer zone
40 deflection compensation roll
42 shoe press roll
44 press roll
46 shoe press roll
48 suction roll
50 elongated nip press
52 press roll
54 central roll
56 forming roll
58 suction roll

60 felt
62 elongated nip press
64 suction roll
66 shoe press

What it claimed is:

1. A wet section of a machine for producing a fibrous material web, comprising:

a web forming section that preforms the fibrous material web, the web forming section comprising a headbox for supplying a fibrous material pulp and dilution water to the machine;

at least one press nip through which the fibrous material web is guided, the at least one press nip comprising an elongated press nip formed between two opposed shoe press rolls having flexible press jackets;

at least a first belt set disposed on one side of the web and at least a second belt set disposed on the other side of the web, with the first belt set and the second belt set being guided with the web through the at least one press nip; and each of the first belt set and the second belt set comprising a woven belt disposed adjacent the web, a porous belt disposed adjacent the woven belt, and a waterproof belt disposed adjacent the porous belt, wherein the waterproof belt comprises one of the flexible press jackets of one of the shoe press rolls;

wherein the press nip is located in the web forming section where a dry matter content of the fibrous material web, as it enters the press nip, does not exceed approximately 15%.

2. The wet section of claim 1, wherein the fibrous material web comprises a paper web.

3. The wet section of claim 1, wherein the fibrous material web comprises a cardboard web.

4. The wet section of claim 1, wherein the dry matter content of the fibrous material web does not exceed approximately 12% as it enters the press nip.

5. The wet section of claim 1, wherein each woven belt comprises a screen belt.

6. The wet section of claim 1, wherein the porous belt comprises a water-absorbing belt.

7. The wet section of claim 6, wherein the water-absorbing belt comprises a felt belt.

8. The wet section of claim 6, wherein the porous belt comprises a woven cloth belt.

9. The wet section of claim 1, wherein the woven belt comprises a woven cloth belt.

10. The wet section of claim 1, wherein the two opposed shoe press rolls are lubricated with water.

11. The wet section of claim 1, further comprising an additional press nip and a transfer zone wherein the fibrous material web moves through the additional press nip and the transfer zone prior to entering a dryer section of said machine, the fibrous material web being guided so that a substantially continuous web guidance is produced.

12. A wet section of a machine that produces a fibrous material web, comprising:

a web forming section that forms the fibrous material web, the web forming section comprising a headbox for supplying a fibrous material pulp and dilution water to the machine;

at least one press nip through which the fibrous material web is guided, the at least one press nip being formed between two opposed shoe press rolls having flexible press jackets;

at least a first belt set disposed on one side of the web and at least a second belt set disposed on the other side of the web, with the first belt set and said second belt set being guided with the web through the at least one press nip; and each of the first belt set and the second belt set further comprising a woven belt disposed adjacent the web, a porous belt disposed adjacent the woven belt, and a waterproof belt disposed adjacent the porous belt, wherein the waterproof belt comprises one of the flexible press jackets of one of the shoe press rolls, wherein the at least one press nip is elongated in a web travel direction, the at least one press nip being located in the web forming section where a dry matter content of the fibrous material web, as it enters the press nip, does not exceed approximately 15%.

13. The wet section of claim 12, wherein the fibrous material web comprises a paper web.

14. The wet section of claim 12, wherein the fibrous material web comprises a cardboard web.

15. The wet section of claim 12, wherein said dry matter content of the fibrous material web does not exceed approximately 12%.

16. The wet section of claim 12, wherein the wet section is located proximate a dryer section with the web traveling from the wet section to the dryer section.

17. The wet section of claim 12, wherein the first belt set comprises the same belt combination as the second belt set.

18. A method for treating a fibrous material web in a wet section of a machine that produces the fibrous material web, wherein the wet section comprises a web forming section including a headbox for supplying a fibrous material pulp and dilution water, at least one elongated press nip formed between two opposed shoe press rolls having flexible press jackets, the press nip being located in the web forming section where a dry matter content of the fibrous material web, as it enters the press nip, does not exceed approximately 15%, the method comprising:

forming the fibrous material web in the web forming section of the machine;

guiding the fibrous material web to the at least one press nip; and pressing the fibrous material web in the at least one press nip, wherein the guiding further comprises passing at least a first belt set disposed on one side of the web and at least a second belt set disposed on the other side of the web through the press nip, with the first belt set and said second belt set being guided with the web through the at least one press nip; and wherein each of the first belt set and the second belt set further comprises a woven belt disposed adjacent the web, a porous belt disposed adjacent the woven belt, and a waterproof belt disposed adjacent the porous belt, wherein the waterproof belt comprises one of the flexible press jackets of one of the shoe press rolls.

19. The method of claim 18, wherein the dry matter content of the fibrous material web does not exceed approximately 12% prior to entering the press nip.

20. A wet section of a machine for producing a fibrous material web, comprising:

a web forming section that preforms the fibrous material web, the web forming section comprising a headbox for supplying a fibrous material pulp and dilution water to the machine;

at least one press nip through which the fibrous material web is guided comprising an elongated press nip formed between two opposed shoe press rolls having flexible press jackets; and a plurality of belts that sandwich said fibrous material web, the at least one nip being located in the web forming section where a dry matter content of the fibrous material web, as it enters said nip, does not exceed approximately 15%, the plurality of belts comprising at least a first belt set disposed on one side of the web and at least a second belt set disposed on the other side of the web, with the first belt set and said second belt set being guided with the web through the at least one press nip;

wherein each of the first belt set and the second belt set comprise a woven belt disposed adjacent the web, a porous belt disposed adjacent the woven belt, and a waterproof belt disposed adjacent the porous belt, wherein the waterproof belt comprises one of the flexible press jackets of one of the shoe press rolls.

21. The wet section of claim 20, wherein each of the first belt set and the second belt set comprise the same belt combination.

22. A wet section of a machine for producing a fibrous material web, comprising:

a web forming section that preforms the fibrous material web, the web forming section comprising a headbox, a forming roll, a first press nip utilizing two shoe press rolls having flexible press jackets, a second press nip utilizing two shoe press rolls, and a third press nip disposed before a dryer section;

the forming roll being disposed before the first press nip;

an upper convergent screen and a lower convergent screen, wherein the web travels around a portion of the forming roll with lower convergent screen disposed between the web and the forming roll and wherein upper convergent screen is disposed on the side of the web opposite the forming roll;

at least a first belt set disposed on one side of the web and at least a second belt set disposed on the other side of the web, with the first belt set and said second belt set being guided with the web through at least the first press nip;

the first belt set further comprising a woven belt disposed adjacent the web, a porous belt disposed adjacent the woven belt, and a waterproof belt disposed adjacent the porous belt, wherein the waterproof belt comprises one of the flexible press jackets of one of the shoe press rolls;

the second belt set further comprising the lower convergent screen disposed adjacent the web, a porous belt disposed adjacent the lower convergent screen, and a waterproof belt disposed adjacent the lower convergent screen, wherein the waterproof belt comprises one of the flexible press jackets of one of the shoe press rolls;

wherein the first press nip is located in the web forming section where a dry matter content of the fibrous material web, as it enters the press nip, does not exceed approximately 15%.

23. A wet section of a machine for producing a fibrous material web, comprising:

a web forming section that preforms the fibrous material web, the web forming section comprising a headbox for supplying a fibrous material pulp and dilution water to the machine;

a forming roll disposed adjacent the headbox;

a plurality of pneumatically loaded blades arranged adjacent to the forming roll so as to allow a web to travel via a screen between the forming roll and the loaded blades;

a first press nip through which the fibrous material web is guided, the first press nip being formed between the forming roll and a shoe press roll having a flexible press jacket;

a second press nip through which the fibrous material web is guided, the second press nip being formed between the forming roll and a suction roll;

a third press nip comprising an elongated press nip formed between two opposed shoe press rolls having flexible press jackets, the third press nip guiding the web via at least a first belt set disposed on one side of the web and at least a second belt set disposed on the other side of the web;

each of the first belt set and the second belt set comprising a woven belt disposed adjacent the web, a porous belt disposed adjacent the woven belt, and a waterproof belt disposed adjacent the porous belt, wherein the waterproof belt comprises one of the flexible press jackets of one of the shoe press rolls;

wherein the first press nip is located in a region of the machine where a dry matter content of the fibrous material web, as it enters the press nip, does not exceed approximately 15%.

* * * * *